US007873178B2

(12) United States Patent
Steere et al.

(10) Patent No.: US 7,873,178 B2
(45) Date of Patent: Jan. 18, 2011

(54) ELECTRO-DYNAMIC PLANAR LOUDSPEAKER

(75) Inventors: John F. Steere, Martinsville, IN (US); Hans-Juergen Regl, Regensburg (DE); Steven W. Hutt, Bloomington, IN (US)

(73) Assignee: Harman International Industries, Incorporation, Northridge, CA (US)

( * ) Notice: Subject to any disclaimer, the term of this patent is extended or adjusted under 35 U.S.C. 154(b) by 1310 days.

(21) Appl. No.: 11/405,856

(22) Filed: Apr. 18, 2006

(65) Prior Publication Data

US 2006/0233417 A1 Oct. 19, 2006

Related U.S. Application Data

(60) Provisional application No. 60/672,741, filed on Apr. 19, 2005.

(51) Int. Cl.
*H04R 25/00* (2006.01)

(52) U.S. Cl. ..... 381/399; 381/398; 381/396; 381/343

(58) Field of Classification Search ..... 381/150, 381/152, 394, 395, 420, 423, 426, 431, 398, 381/399, 396, 343
See application file for complete search history.

(56) References Cited

U.S. PATENT DOCUMENTS 5,905,805 A * 5/1999 Hansen ..... 381/398
2004/0258269 A1* 12/2004 Halsall et al. ..... 381/387

* cited by examiner

*Primary Examiner*—Suhan Ni
*Assistant Examiner*—Jasmine Pritchard
(74) *Attorney, Agent, or Firm*—Pauley Petersen & Erickson

(57) ABSTRACT

A planar loudspeaker includes a shell pot, a magnet, a diaphragm, and a face plate. The magnet may be positioned in a cavity in the shell pot. The diaphragm may be coupled with the shell pot to cover an entrance to the cavity. The shell pot may include a conductive path having an inner contact proximate the central axis of the diaphragm, and an outer contact proximate to a perimeter of the diaphragm. The face plate may be coupled with the shell pot so that the diaphragm is positioned between the magnet and the faceplate. The face plate may include an inner terminal and an outer terminal that are aligned to be in direct contact with the respective inner contact and the outer contact of the diaphragm and form an electrical connection there between when the face plate is coupled with the shell pot. The inner and outer terminals may be coupled with a source of electrical signals, such as an audio amplifier. The face plate may also include a raised surface that deflects the diaphragm into a predetermined shape when the face plate is coupled with the shell pot.

32 Claims, 9 Drawing Sheets

ELECTRO-DYNAMIC PLANAR LOUDSPEAKER

PRIORITY CLAIM

This application claims priority to U.S. Provisional Application No. 60/672,741, filed on Apr. 19, 2005, which is incorporated herein by reference.

BACKGROUND OF THE INVENTION

1. Technical Field

The present invention relates to loudspeakers, and more particularly, to electro-dynamic planar loudspeakers and related manufacturing methods.

2. Related Art

In the field of planar loudspeakers, a diaphragm in the form of a thin film is attached in tension to a frame. A conductive path may be formed on the surface of the diaphragm. An electrical signal, such as an audio signal, may be applied to the conductive path. A magnet may be mounted proximate to the diaphragm such that the electrical signal applied to the conductive path causes the diaphragm to interact with the magnetic field. This interaction can cause the diaphragm to vibrate, thereby producing sound.

Planar speakers can present many types of manufacturing challenges. Typically, a pair of jumper wires is used to connect the conductive path on the surface of the diaphragm to terminals that serve as inputs for the electrical signal. However, the assembly of loudspeakers with these small wires is difficult and adds to the manufacturing cost. Additionally, a solder may be used to provide an electrical connection between the conductive path and the terminals, which may add to the assembly cost. Moreover, the use of solder connections and associated heating used to form these connections may have adverse effects on plastic components included in the loudspeaker.

In some cases, the conductive path is fabricated from aluminum, which can cause additional difficulties. An aluminum conductor may require the use of solders with a corrosive flux to break through the aluminum oxide on the surface of the conductive path before the solder joint can be formed. Residual corrosive flux is then neutralized or removed to prevent future corrosion.

Additionally, mechanical standoffs may be inserted between the magnet and diaphragm of a planar speaker to provide sufficient clearance for the diaphragm to vibrate. The mechanical standoffs add to the number of components and steps required to assemble the loudspeaker, which can increase the cost of assembly.

Therefore, a need exists for an improved planar loudspeaker that overcomes the aforementioned difficulties.

SUMMARY

A planar loudspeaker includes a magnet disposed in a cavity formed in a shell pot. A diaphragm may be positioned to cover an entrance to the cavity such that a conductive path formed on the diaphragm is positioned in a magnetic field produced by the magnet. The planar loudspeaker also includes a face plate coupled with the shell pot. The face plate may include terminals that form a direct electrical connection with the conductive path formed on the diaphragm. Audio signals may be supplied from an audio source to the terminals in order to vibrate the diaphragm in the presence of the magnetic field to produce sound.

A direct connection between the terminals and the conductive path of the diaphragm eliminates the use of jumper wires, such as litz wires, along with the attendant complexities of assembling the loudspeaker to electrically connect the small jumper wires to terminals. Accordingly, the loudspeaker may be assembled in a relatively simple manner and with fewer components required to complete assembly. Further, the use of solder to make electrical connection to the loudspeaker also may be eliminated. This removes the difficulties of using solder in conjunction with plastic components, as well as environmental and corrosion issues that may be associated with the use of solder.

Some loudspeakers may also be configured without mechanical standoffs, such as spacers, between the diaphragm and magnet. Instead of using mechanical standoffs, the diaphragm may be placed in tension such that the diaphragm is maintained in a determined shape, such as a substantially conical shape. The tension under which the diaphragm is placed also may reduce distortion.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION OF THE PREFERRED EMBODIMENTS

Figure 1:
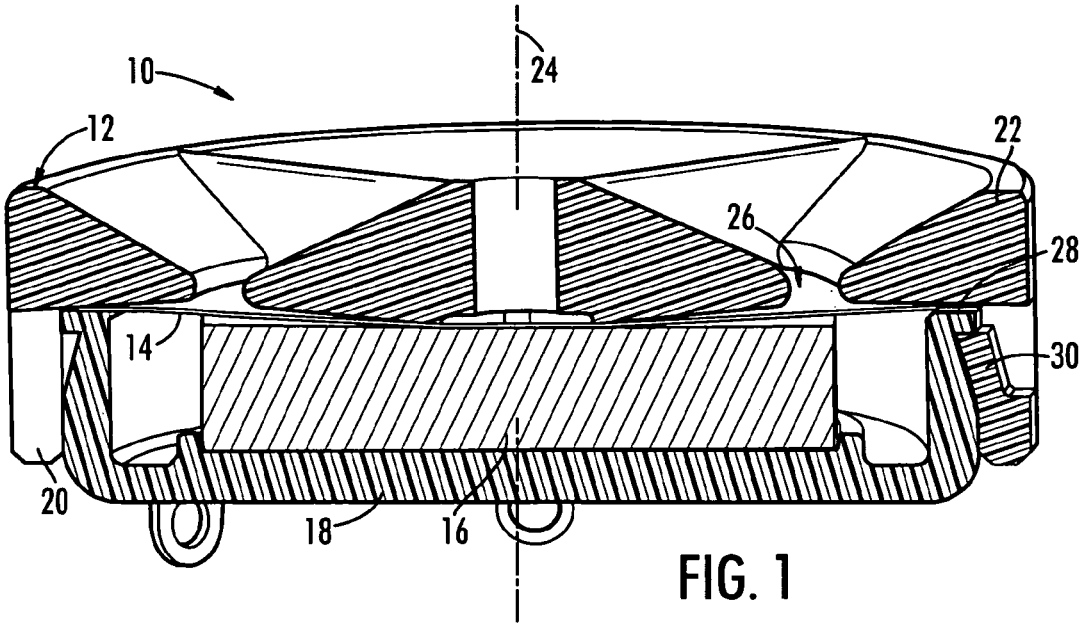
FIG. 1 is a side, cross-sectional view of an example planar loudspeaker.

FIG. 1 is an example loudspeaker 10 with a face plate 12, a vibrating diaphragm 14, a magnet 16 and a shell pot 18. The loudspeaker 10 may be a planar type loudspeaker of any size and/or operating frequency range. A planar loudspeaker refers to a loudspeaker with a flat or almost flat diaphragm that may also include a waveguide. In a planar loudspeaker, the acoustic wave emanating from the vibrating flat diaphragm may be a plane wave. Thus, the wave may appear to have the same amplitude everywhere on a plane perpendicular to a direction of travel of the wave.

The faceplate 12 may be made of a semi-rigid yet flexible material, such as plastic. In one example, the faceplate 12 may be formed by injection molding using a mold. The face plate 12 may include an annular wall 20 extending around the perimeter of a base wall 22. The shell pot 18 may form a cavity that may be dimensioned to receive the magnet 16. In the example shown, the face plate 12, the vibrating diaphragm 14, the magnet 16 and the shell pot 18 are generally circular in shape and concentric with a central axis 24. In other examples, the loudspeaker 10 and associated components may have other geometric configurations, such as substantially oval, substantially rectangular, substantially square or any other suitable shape. The face plate 12 may have a radiating opening 26 proximate to the vibrating diaphragm 14 that may direct sound waves emanated from the loudspeaker 10.

The face plate 12 may be coupled with the shell pot 18 to form a cover over the cavity formed in the shell pot 18. In the example shown, the shell pot 18 has a rim 28 that can engage a clip 30 on an annular wall 20 of the face plate 12 when the face plate 12 is pressed on to the shell pot 18. The face plate 12 may have one or more clips 30 that engage with the shell pot 18. For example, the face plate 12 may include three integral clips 30. In other examples, any number of clips 30 may be included to securely engage the face plate 12 with the shell pot 18. This arrangement allows a rigid attachment between the shell pot 18 and the face plate 12 without the use of adhesive or external fasteners, such as rivets or screws. In other examples, however, the face plate 12 may be connected to the shell pot 18 using adhesive or external fasteners, such as screws, clamps, or rivets. In other examples, the face plate 12 may attach to the shell pot 18 using a friction fit, a threaded connection, or any other mechanism that provides for a secure and substantially rigid engagement of the face plate 12 with the shell pot 18.

Figure 2:
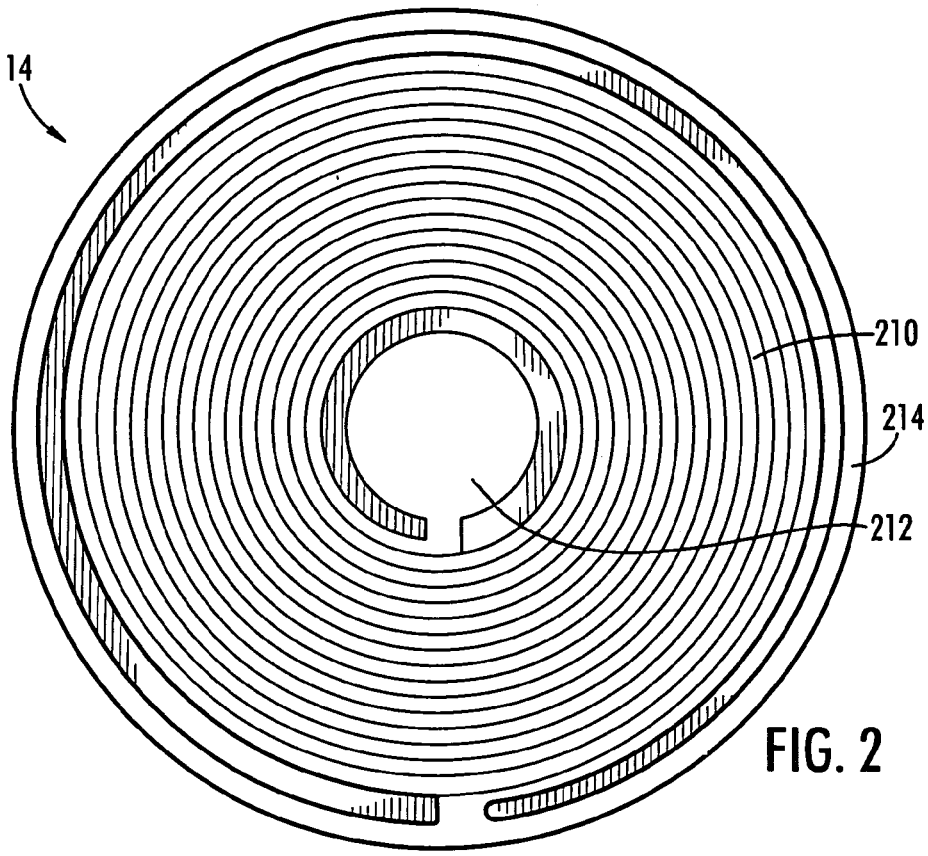
FIG. 2 is a top view of an example diaphragm that may be used in the loudspeaker of FIG. 1.

FIG. 2 illustrates an example diaphragm 14. The diaphragm 14 may be a film or any other flexible material capable of being vibrated to produce sound. The diaphragm 14 may form a planar surface positioned in the loudspeaker 10 proximate to a magnetic field created by the magnet 16 (FIG. 1). A conductive path 210 may be formed in or on the top and/or bottom of the diaphragm 14. The conductive path 210 may be formed as a substantially spiral path as shown in FIG. 2. The conductive path 210 could also be formed using other routes and/or patterns that enable an electromagnetic field of the magnet 16 to intersect and interact with the conductive path 210, and cause vibrational movement of the diaphragm 14. The conductive path 210 may be formed on the diaphragm 14 by etching a conductive path on the diaphragm, depositing a conductive material on a film or using any other techniques for forming conductive substrates on a film. In addition, or alternatively, the conductive path 210 may be formed in the diaphragm 14 as part of the diaphragm manufacturing process.

The conductive path 210 may include an inner contact 212 and an outer contact 214. The inner contact and outer contacts 212 and 214 may be used as input or output conducting surfaces for transmitting an electrical signal across the conductive path 210. The inner contact 212 may be a conductive substrate forming a planar surface that extends radially outward a predetermined distance from the central axis 24 of the diaphragm 14. Thus, the inner contact 212 may be proximate to the center of the conductive path 210. The inner contact 212 need not be positioned near or in the center of the conductive path 210, and instead may be positioned in any location that enables electrical conductivity with the faceplate 12 as described later. The outer contact 214 may be positioned proximate to a perimeter, or outer peripheral edge of the conductive path 210. In the example shown, the outer contact 214 has an annularly shaped planar surface that substantially surrounds the inner contact 212 and the rest of the conductive path 210, and provides a conducting surface. In other examples, the outer contact 214 may be any other shape that enables electrical conductivity with the faceplate 12.

Figure 3:
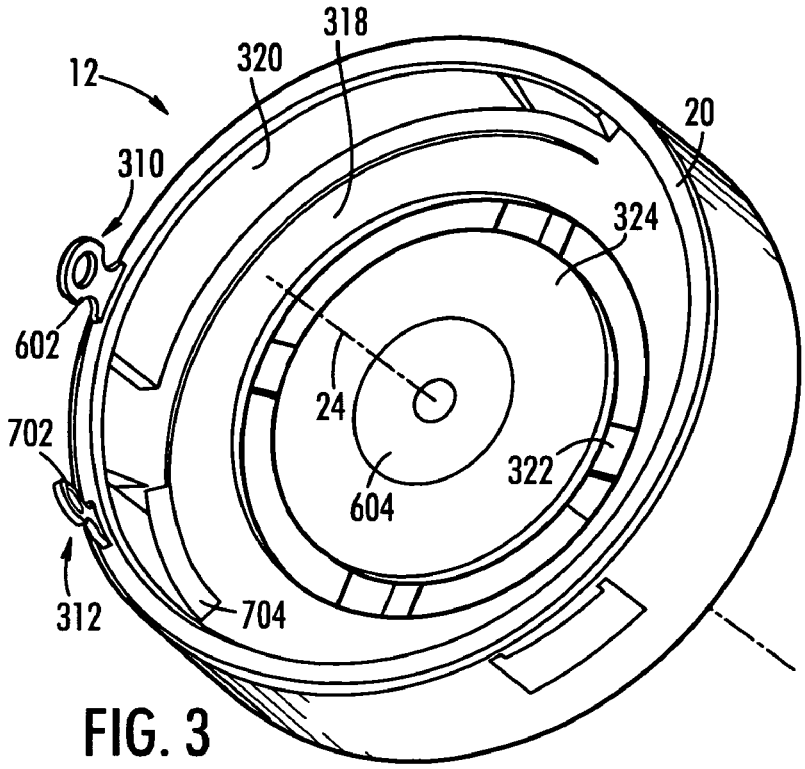
FIG. 3 is a bottom, perspective view of the face plate shown in FIG. 1.
Figure 4:
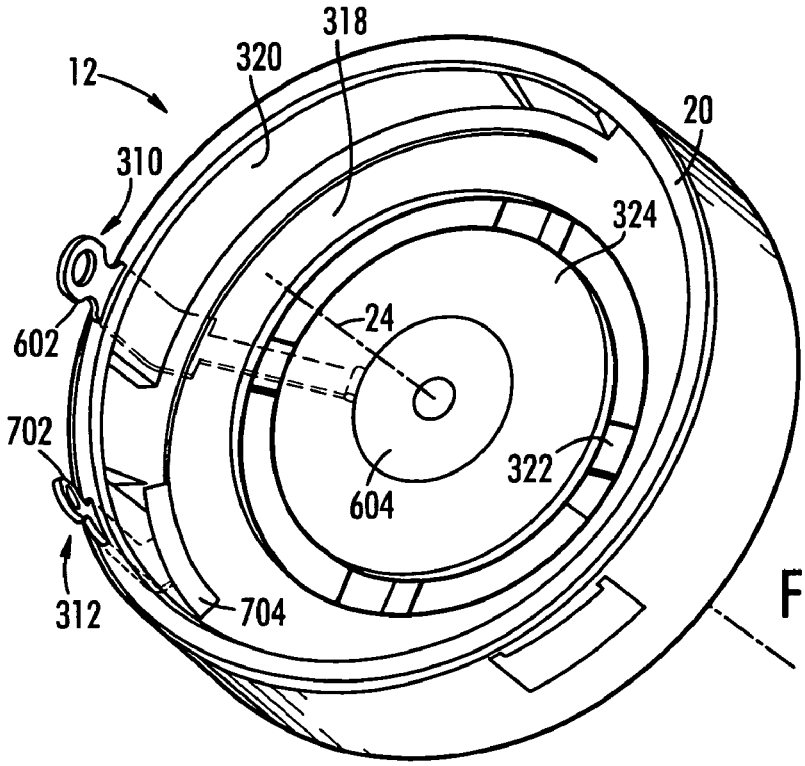
FIG. 4 is a bottom, perspective view of the face plate of FIG. 3 showing an example position of the inner terminal and outer terminal.

FIGS. 3 and 4 are perspective views of an example faceplate 12 that includes an inner terminal 310 and an outer terminal 312. The inner and outer terminals 310 and 312 may be formed of an electrically conductive material, such as tinned brass. In FIGS. 3 and 4, the inner and outer terminals 310 and 312 are positioned in the annular wall 20 and a base wall 318 of the faceplate 12. In one example, during manufacture, the inner and outer terminals 310 and 312 may be positioned in a mold into which plastic, or any other molding material, is injected to form the faceplate 12. Thus, the inner and outer terminals 310 and 312 may be molded into the plastic that forms the faceplate 12, as illustrated in FIG. 4 with dotted lines. Thus, the faceplate 12 may be formed of a non-conducting material that provides an insulating layer between the inner and outer terminals 310 and 312 and the shell pot 18. As described later, the faceplate 12 may be formed to include a phase plug as illustrated in FIGS. 3 and 4.

Figure 5:
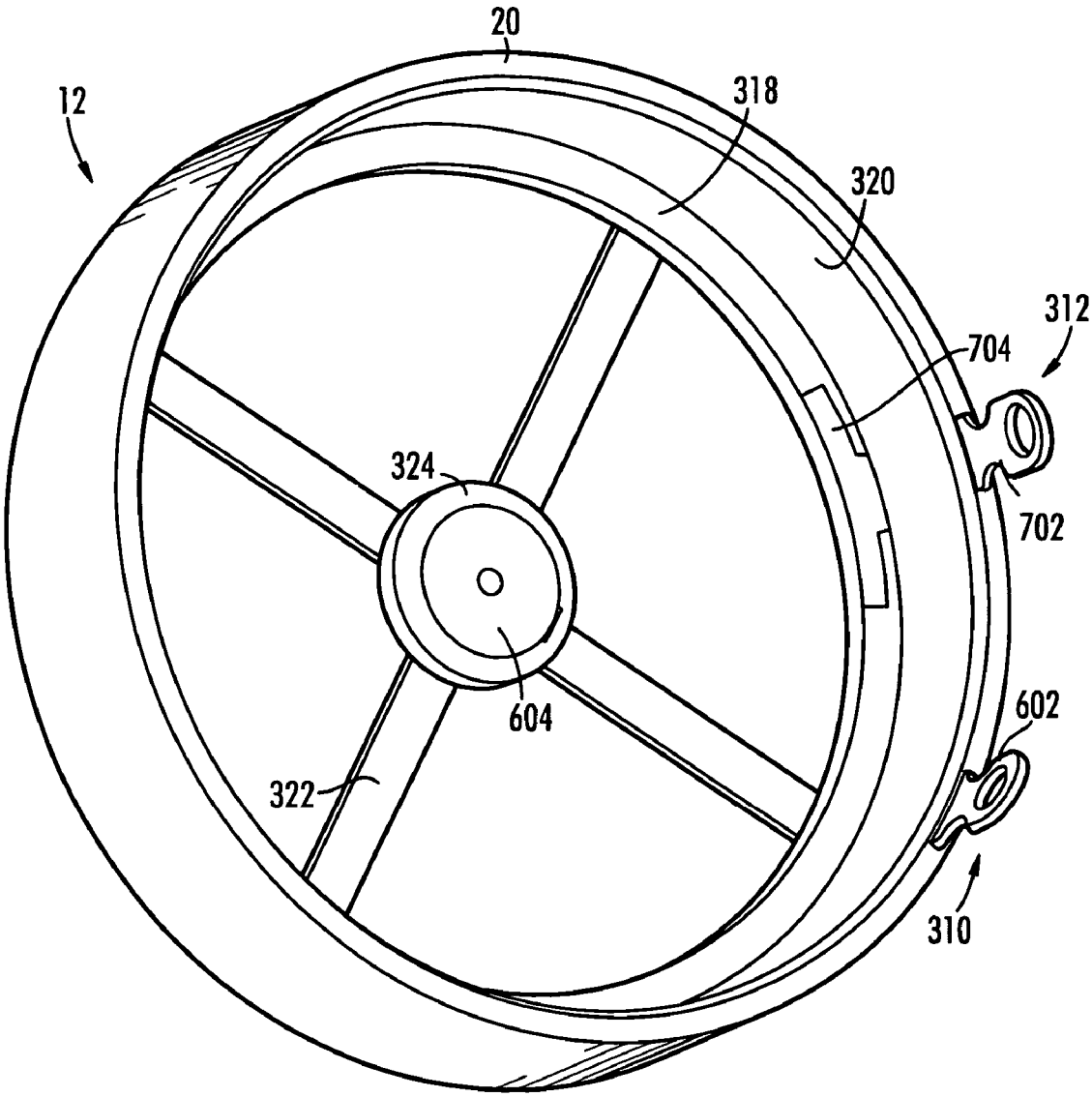
FIG. 5 is a bottom, perspective view of an example face plate with a phase plug.

FIG. 5 shows an example of a faceplate 12 that includes the struts 322, the phase plug 324, and the inner and outer terminals 310 and 312. In FIG. 5, however, the phase plug 324 does not cover the vibrating portion of the diaphragm 14. Accordingly, the phase plug 324 in this example is a hub that does not affect the phase of the sound wave generated by the loudspeaker, but still may include/support the inner terminal 312, and can be used to physically deflect the diaphragm 14 as described later.

Figure 6:
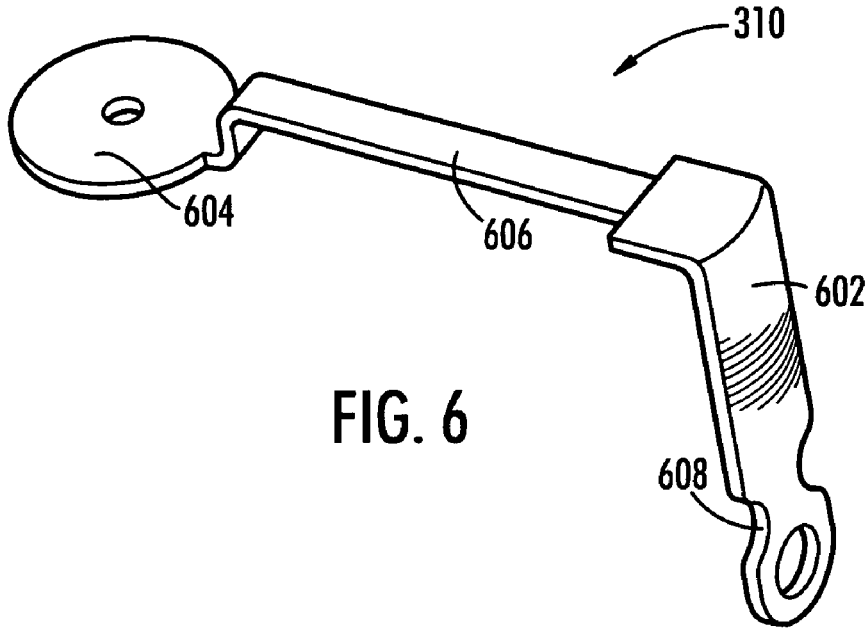
FIG. 6 is a perspective view of an example inner terminal that may be used in the loudspeaker of FIG. 1.
Figure 7:
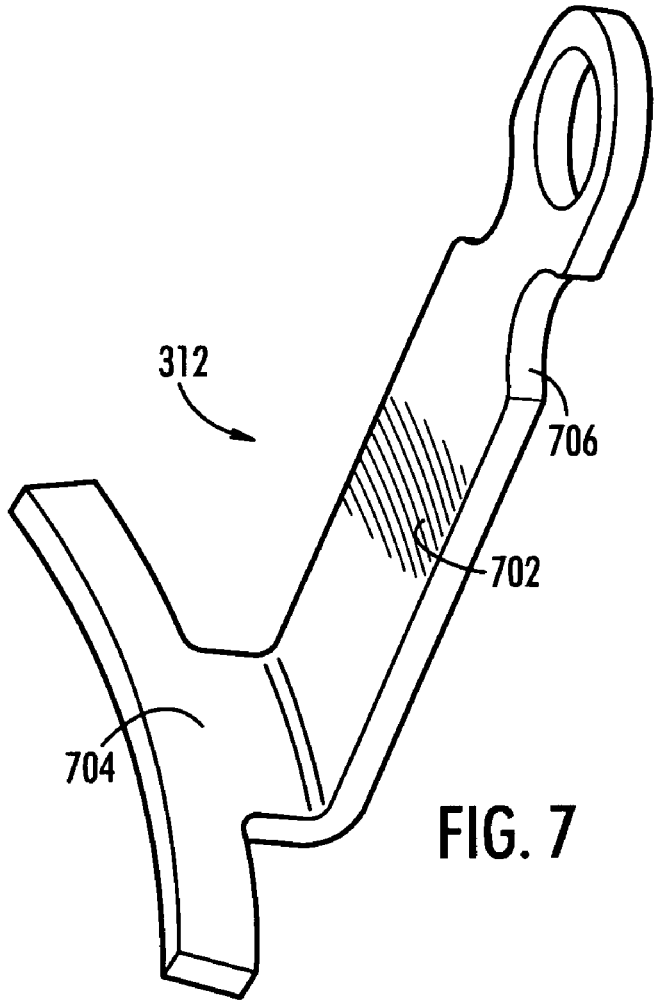
FIG. 7 is a perspective view of an example outer terminal that may be used in the loudspeaker of FIG. 1.

FIG. 6 is a perspective view of an example inner terminal 310. The inner terminal 310 includes a termination point 602 and a first contact 604 electrically coupled with a conductive channel 606. FIG. 7 is a perspective view of an example of the outer terminal 312. The outer terminal 312 includes a termination point 702 electrically coupled with a second contact 704. The inner and outer terminals 310 and 312 may be any substantially rigid electrically conducting material of single piece, unitary construction. Alternatively, the inner and outer terminals 310 and 312 may be formed with multiple members that are coupled together.

The termination points 602 and 702 may be positioned to extend away from the faceplate 12. In FIGS. 3-5, the termination points 602 and 702 are positioned in the annular wall 20 substantially parallel with respect to the central 15 axis 24 and the annular wall 20. Alternatively, the termination points 602 and 702 may be positioned to extend perpendicularly or any other direction with respect to the central axis 24 and the annular wall 20.

In one example, the termination points 602 and 702 may include an aperture formed to receive a conductor or some other conduit for electrical signals from a source external to the loudspeaker 10, such as an audio amplifier. A conductor may be coupled to each of the termination points 602 and 702 with a fusible alloy, such as solder. Alternatively, the termination points 602 and 702 may form or couple a male or female half of a connector, a lug, a compression fitting, or any other form of fastener capable of receiving electrical signals from a source external to the loudspeaker 10. When formed to be positioned substantially parallel with the central axis 24 and the annular wall 20, each of the termination points 602 and 702 also may be formed with a predetermined radius of curvature as illustrated in FIGS. 6 and 7. The predetermined radius of curvature may be substantially similar to the radius of curvature of the annular wall 20 in the vicinity of where the termination points 602 and 702 are coupled with, and/or embedded in, the annular wall 20.

Each of the termination points 602 and 702 may also include a neck portion 608 and 706. The neck portion 608 and 706 may provide a thermal break to mitigate heat associated with soldering being transmitted into the face plate 12. In addition, the neck portions 608 and 706 may provide a mechanical flexibility point that allows the termination points 602 and 702 to bend at a predetermined location when subject to forces in excess of a determined magnitude.

In FIGS. 3-5, the base wall 318 of the face plate 12 includes a plurality of struts 322 that extend radially outward from the central axis 24 of the faceplate 12. The conductive channel 606 of the inner terminal 310 may be embedded in, and/or coupled with one of the struts 322 as best illustrated in FIG. 4. The struts 322 may extend between a phase plug 324 and the base wall 318 and/or the annular wall 20. The first contact 604 of the inner terminal 310 may also be embedded in and/or coupled with the phase plug 324. Thus, in some examples, the inner terminal 310 and the outer terminal 312 may be integral with the face plate 12. If the face plate 12 were formed from plastic, for example, a portion of the inner terminal 310 and the outer terminal 312 may be embedded in the plastic. In other examples, at least some portion of the inner terminal 310 and/or the outer terminal 312 may be coupled to the face plate 12 in other ways, such as with a rivet, a screw, or an adhesive.

In FIGS. 1-7, when the loudspeaker 10 is fully assembled, the inner contact 212 of the conductive path 210 may form an electrical connection with the first contact 604 of the inner terminal 310. In addition, the outer contact 214 of the conductive path 210 may form an electrical connection with the second contact 704 of the outer terminal 312. The position of the inner contact 604 and the second contact 704 of the face plate 12 may be aligned to form an electrical connection with the inner contact 212 and the outer contact 214 of the conductive path 210, respectively.

In FIGS. 3-5, the first contact 604 of the face plate 12 may be centrally positioned near the center of the face plate 12 while the second contact 704 of the face plate 12 may be positioned at or near the perimeter of the face plate 12 adjacent an inner surface 320 of the annular wall 20. This configuration may be axially aligned with the example diaphragm 14 described with reference to FIG. 2. Due to the configuration of the inner and outer contacts 212 and 214 of the diaphragm 14 and the first and second contacts 604 and 704 of the face plate 12, the need to rotationally orient the diaphragm 14 with respect to the face plate 12 to obtain an electrical connection is unnecessary. The position of the contacts 212, 214, 604 and 704 may be different in other examples. For example, where a conductive path 210 is disposed on each side of the diaphragm 14, all of the contact points may be near the peripheral edge of the diaphragm 14. Accordingly, the position of the first contact 604 and the second contact 704 of the face plate 12 may vary depending upon the position of the inner contact 212 and the outer contact 214 of the conductive path 210.

The contiguous positioning of the respective inner and outer contacts 212 and 214 of the conductive path 210 and the respective first and second contacts 604 and 704 of the face plate 12 may result in a low resistance conductive path therebetween. Low resistance electrical conductivity may also be enhanced, obtained, and/or maintained using a compliant electrical interface (not shown). The compliant electrical interface may be a conductive spring, a conductive fuzz button, or any other substantially deformable conductive material with memory that allows the compliant electrical interface to substantially return to its original shape. In one example, the compliant electrical interface may be a stainless steel or beryllium copper spring made with about 0.08 mm wire that is about 5 mm long. The compliant electrical interface may be positioned on the contacting surface of one or more of the inner and/or outer contacts 212 and 214 of the conductive path 210 and/or the first and/or second contacts 604 and 704 of the terminals 310 and 312.

When the loudspeaker 10 is assembled, the one or more compliant electrical interfaces may be compressed between the contacts 212 and 604 and/or 214 and 704 to form a low resistance conductive path therebetween. In another example, one or more of the contacts 212, 214, 604 and 704 may protrude outwardly towards each other, and may be deformable with memory to ensure a low resistance signal path. In still other examples, a conductive grease, such as that sold under the name Tecknit Conductive Grease by Tecknit, Inc. of Cranford, N.J. may be used between the respective first contact 604 or the second contact 704 of the face plate 12 and the respective inner contact 212 or the outer contact 214 of the conductive path 210 to maximize conductivity and to also serve as a moisture barrier.

The direct electrical contact between the face plate 12 and diaphragm 14 eliminates the use of external wires for an electrical connection. This reduces the number of components required to complete assembly of the loudspeaker 10 and the labor costs attendant with assembling such external wires. Additionally, this type of direct contact enables the automation of the assembly process. The direct connection also eliminates soldering equipment to complete the electrical connection. Therefore, the environmental and corrosion issues associated with solder and heat effects of soldering on or near plastic components also may be eliminated. Additionally, the direct connection may eliminate a common failure of loudspeakers, particularly tweeters, with flexible lead wires, when the lead wires eventually vibrate loose and/or break and an electrical connection is lost.

Termination points 602 and 702 of the inner terminal 310 and the outer terminal 312 may conduct an electrical signal, such as an audio signal. The electrical signal can therefore be transmitted to the conductive path 210 of the diaphragm 14. In another example, the outer contact 214 of the diaphragm 14 may be lengthened to form a terminal that extends outward beyond the annular wall 20 of the face plate 12. In this example, the outer terminal 312 may be omitted since a conductor providing an electrical signal, such as an audio signal, may be terminated directly to the outer contact 214. In yet another example, the shell pot 18 may be electrically connected with the outer contact 214, and a conductor terminated to the shell pot 18 may provide an electrical signal, such as an audio signal, via the shell pot 18 to the conductive path 210 of the diaphragm 14.

As the magnitude of the current in the electrical signal supplied to the loudspeaker 10 changes, the interaction of the conductive path 210 of the diaphragm 14 with the magnetic field produced by the magnet 16 will cause the diaphragm 14 to vibrate and produce sound. The directivity of the sound produced by the loudspeaker 10 may be controlled with a phase plug.

Figure 8:
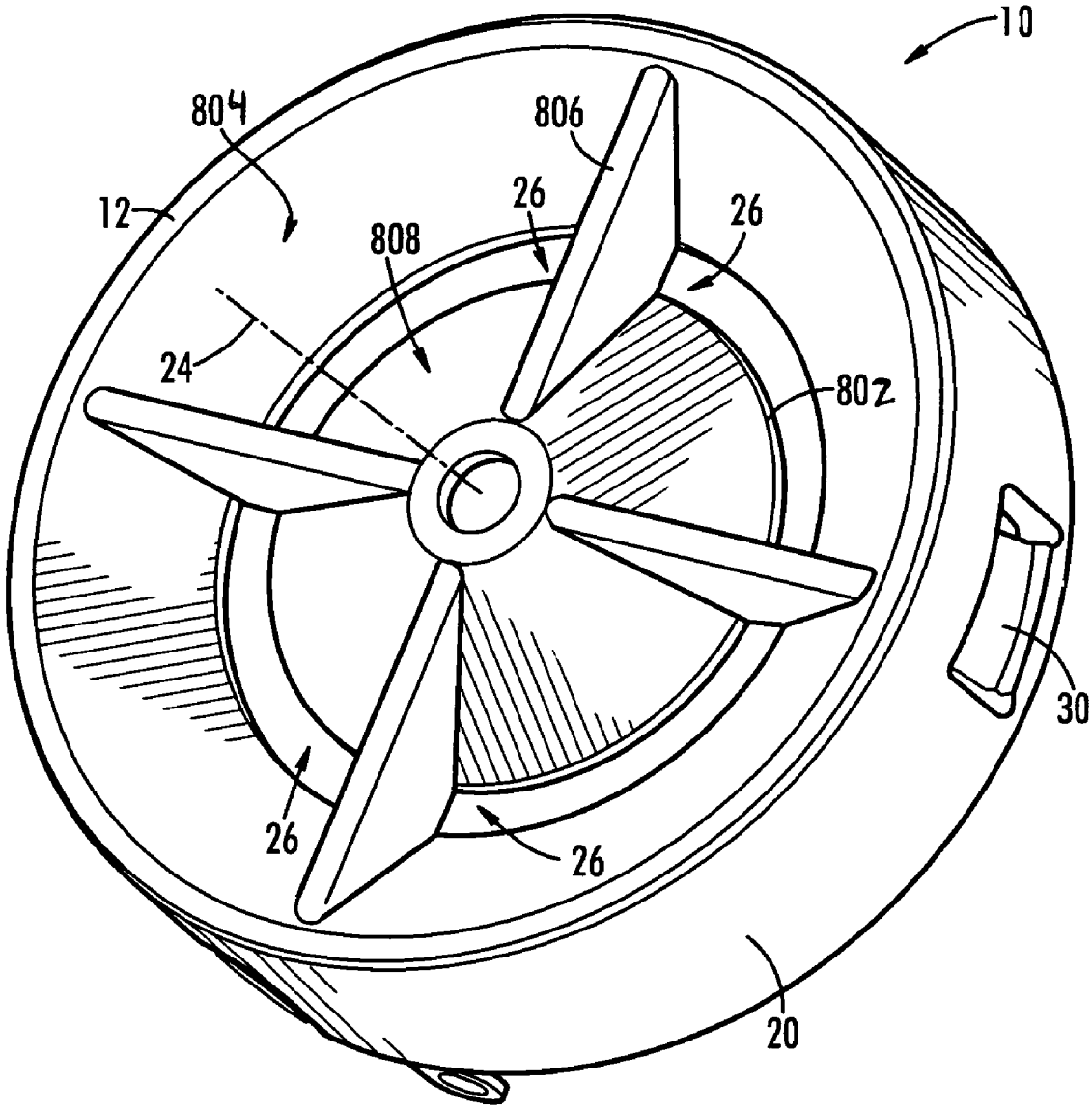
FIG. 8 is a top, perspective view of an example face plate with a phase plug that may be used in the loudspeaker of FIG. 1.

FIG. 8 is a perspective view of a loudspeaker 10 that includes a faceplate 12 having an integrally formed phase plug 802. FIGS. 1, 3 and 4 depict other examples of integrally formed phase plugs. In FIG. 8, the face plate 12 also includes a tapered surface of a base wall 804, and a plurality of struts 806 coupled between the base wall 804 and the phase plug 802. The tapered surface of the base wall 804 may extend with a predetermined slope from the annular wall 20 toward the central axis 24 and form a wave guide. The phase plug 802 may include a tapered surface 808 that is generally frusto-conically shaped with a predetermined slope that also forms a wave guide. The wave guides may determine a polar pattern of the sound waves produced when the diaphragm 14 is vibrated. The predetermined slope of the tapered surface 808 may extend away from the central axis 24 toward the annular wall 20. The combination of the tapered surface of the base wall 804 and the tapered surface 808 of the phase plug 802 may form a trough and the radiating opening 26 at, or near, the bottom of the trough.

The radiating opening 26 in the face plate 12 may have various geometric configurations depending upon the desired performance of the loudspeaker 10. The configuration of the radiating opening 26 may be dependent on the positioning and shape of the base wall 804 and the phase plug 802. In other examples, the base wall 804 and the phase plug 802 may be formed and/or positioned in any desirable geometric configuration to produce one or more radiating openings 26 and resulting sound wave directivity(s). In another example, an acoustic lens (not shown) may be used in conjunction with and/or may be a unitary part of the face plate 12, and/or integrally formed in the face plate 12. A discussion of suitable acoustic lens designs can be found in co-pending application Ser. No. 10/768,283 entitled Acoustic Lens System, filed on Jan. 29, 2004, the entire disclosure of which is hereby incorporated by reference.

Figure 9:
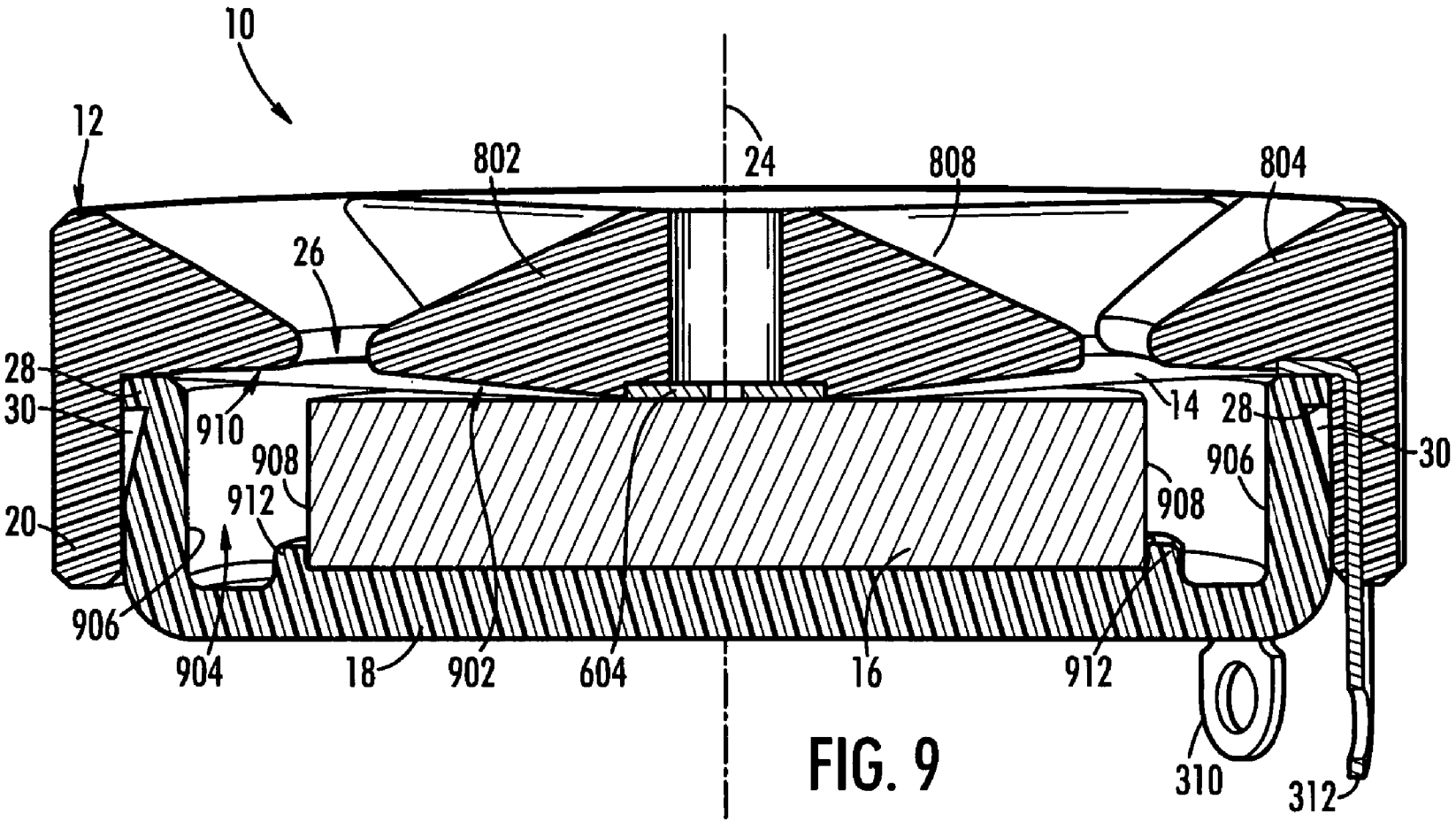
FIG. 9 is a side, cross-sectional view of an example planar loudspeaker.

FIG. 9 is a side cutaway view of the example loudspeaker 10 depicted in FIG. 8. The loudspeaker 10 includes a face plate 12, a diaphragm 14, a magnet 16 and a shell pot 18. As previously discussed, the changing current of electrical signals applied to the terminals 310 and 312 of the loudspeaker 10 causes vibration of the diaphragm 14 to produce sound. The sound waves may emanate from the radiating opening 26 and be directed with the wave guides (the tapered surface of the base wall 804, and the tapered surface 808). Vibration of the diaphragm 14 is enabled by suspending at least a portion of the diaphragm 14 in an air space. The air space may be formed between the magnet 16 and the faceplate 12 to be at least about 0.3 mm to about 0.4 mm. In some examples, a mechanical standoff, such as a spacer (not shown) may be provided between the magnet 16 and diaphragm 14 to provide clearance for the unobstructed vibration of the diaphragm 14.

In the example shown in FIG. 9, however, no mechanical standoff is employed to provide clearance for the movement of the diaphragm 14. Instead, the diaphragm 14 may be distorted or changed from a planar surface into a substantially conically shaped surface. For example, during manufacture, the perimeter of the diaphragm 14 may be coupled with the rim 28 of the shell pot 18 in a neutral tension. The rim 28 may lie in a single longitudinal plane and extend around an outer periphery of the shell pot 18. When the diaphragm 14 is coupled with the rim 28, the diaphragm 14 may form a planar surface that is coplanar with the longitudinal plane of the rim 28. The diaphragm 14 may be coupled with the rim 28 of the shell pot 18 with adhesive, compression between opposed surfaces, fasteners, or any other coupling mechanism.

A component on the opposite side of the diaphragm 14 from the magnet 16 may be positioned with a raised surface of the component against the diaphragm 14. An apex of the raised surface may contact the diaphragm to force an area of the diaphragm 14 to be deflected or displaced outside of the plane defined by the rim 28 and the perimeter of the diaphragm 14. In other words, a portion of the diaphragm 14, such as a central area of the diaphragm 14, may be displaced to be moved out of one plane and reside in a second plane, or planes, that are different than the plane that the perimeter of the diaphragm 14 resides in. Accordingly, at least a portion of the surface of the diaphragm 14 may be uniformly or non-uniformly tapered in an area between the outer peripheral edge of the diaphragm 14 and the central axis 24.

In FIG. 9, the component is the faceplate 12, and the first contact 604 may be the raised portion used to deflect a portion of the diaphragm 14 to form the diaphragm 14 in a conical shape. In other examples, the diaphragm 14 may be displaced at other than a central area. In addition, in other examples, a mechanical standoff, ridges on the faceplate 12, or any other mechanism may be used to deflect at least a portion of the diaphragm 14 to form the conical shape. In still other examples, the diaphragm 14 may be coupled with the magnet 16 and/or the faceplate 12, and the shell pot 18 may be used to deflect the diaphragm 14 into a conical shape. In still other examples, the faceplate 12 may include an inner surface and an outer surface that are coupled with the diaphragm 14 to deflect and form at least a portion of the diaphragm 14 into a conical shape.

In the example shown in FIG. 9, the phase plug 802 with the first contact 604 coupled thereto may be used to not only deflect the diaphragm 14 into a generally conical shape, but also sandwich the diaphragm 14 between the contact 604 and the magnet 16 to maximize electrical conductivity between the inner contact 212 (FIG. 2) on the diaphragm 14, and the first contact 604 included in/on the faceplate 12. In FIG. 9, the phase plug 802 includes a first surface, which is the tapered surface 808, and an opposing second surface, which is a phasing geometry surface 902. The phasing geometry surface 902 generally faces the diaphragm 14 and the magnet 16 when the loudspeaker 10 is assembled.

The phasing geometry surface 902 may be a bottom surface and may be tapered such that the contact area between the phase plug 802 and the diaphragm 14 is less than the total surface area of the phasing geometry surface 902. The taper of the phasing geometry surface 902 may create an angle between the phasing geometry surface 902 and the magnet 16, such as in the range of about 1 degree to about 5 degrees. The angle may result in a predetermined clearance, such as about 0.3 mm to about 1.5 mm in which the diaphragm 14 may freely vibrate. The taper of the phasing geometry surface 902 may be such that the phasing geometry surface 902 is substantially parallel with, and spaced away, from the substantially conically shaped portion of the adjacently positioned diaphragm 14. In addition, due to the substantially conical shape of the diaphragm 14, the surface of the magnet 16 adjacent the diaphragm 14 may also be spaced away from the diaphragm 14.

A portion of a first side of the diaphragm 14 may be suspended over an air gap 904 formed between an inner surface 906 of the shell pot 18 and a surrounding peripheral surface 908 of the magnet 16. Due to the deflection of the diaphragm 14 and the resulting conical shape thereof, a clearance also may be developed between the diaphragm 14 and a portion of the base wall 804 that overhangs a second side of the diaphragm 14 opposite the first side. The portion of the base wall 804 is a phasing geometry surface 910. The phasing geometry surface 902 and the phasing geometry surface 910 may cooperatively operate phasing of the sound wave produced by the loudspeaker. The radiating opening 26 is also adjacent the second side of the diaphragm 14. Thus, the diaphragm 14 may vibrate unimpeded between the outer periphery of the diaphragm 14 and the contact point created between the inner contact 212 of the diaphragm 14 and the first contact 604 of the inner terminal 310. In some examples, the ratio between the area of the diaphragm 14 that may freely vibrate and the area of the radiating opening 26 may be in a range between about 2:1 and about 8:1. In other examples, the ratio of areas may be in a range between about 1:1 (no phase plug covering a radiating portion of the diaphragm 14) and about 8:1. In still other examples, the ratio of the areas may be in a range between about 1.5:1 and about 2.5:1.

In another example configuration, the surface of the magnet 16 that is next adjacent the diaphragm 14 may be formed to include a tapered or sloped surface to increase the airspace in which the diaphragm 14 can freely vibrate. The surface of the magnet 16 may be tapered such that a first portion of the surface may be in contact with the diaphragm 14, and a second portion of the surface of the magnet 16 may slope away from the diaphragm 14. In other examples, the second portion of the surface of the magnet 16 may be notched, stepped, slotted or otherwise moved out of a plane in which the first portion of the surface lies in order to increase the airspace in which the diaphragm 14 can vibrate. One surface of the magnet 16 may be next adjacent the diaphragm 14, and an opposite surface of the magnet 16 may be contiguous and parallel with shell pot 18. In one example, a first portion of the surface of the magnet 16 next adjacent to the diaphragm 14 may be parallel with the surface of the magnet 16 contiguous with the shell pot 18, while a second portion of the surface of the magnet 16 next adjacent the diaphragm 14 may be formed in a plane that is not parallel with the second surface. The second portion of the surface of the magnet 16 next adjacent the diaphragm 16 may be tapered, sloped, notched, etc.

In FIG. 9, the shell pot 18 may include an annular rib 912. The rib 912 may be formed to surround a portion of the surrounding peripheral surface 908 of the magnet 16 to reduce lateral movement of the magnet 16 with respect to the central axis 24. In addition, or alternatively, adhesives, fasteners, compression, friction fit or any other holding mechanism(s) may be employed to reduce lateral movement of the magnet 16. The magnet 16 also may be held in place using other techniques, such as those described in application Ser. No. 10/942,179 entitled Magnet Retention System in Planar Loudspeaker, filed on Sep. 16, 2004, the entire disclosure of which is hereby incorporated by reference. In some examples, the shell pot 18 may be a magnetically conductive material, such as steel to attract and maintain the position of the magnet 16 with respect to the shell pot 18.

Figure 10:
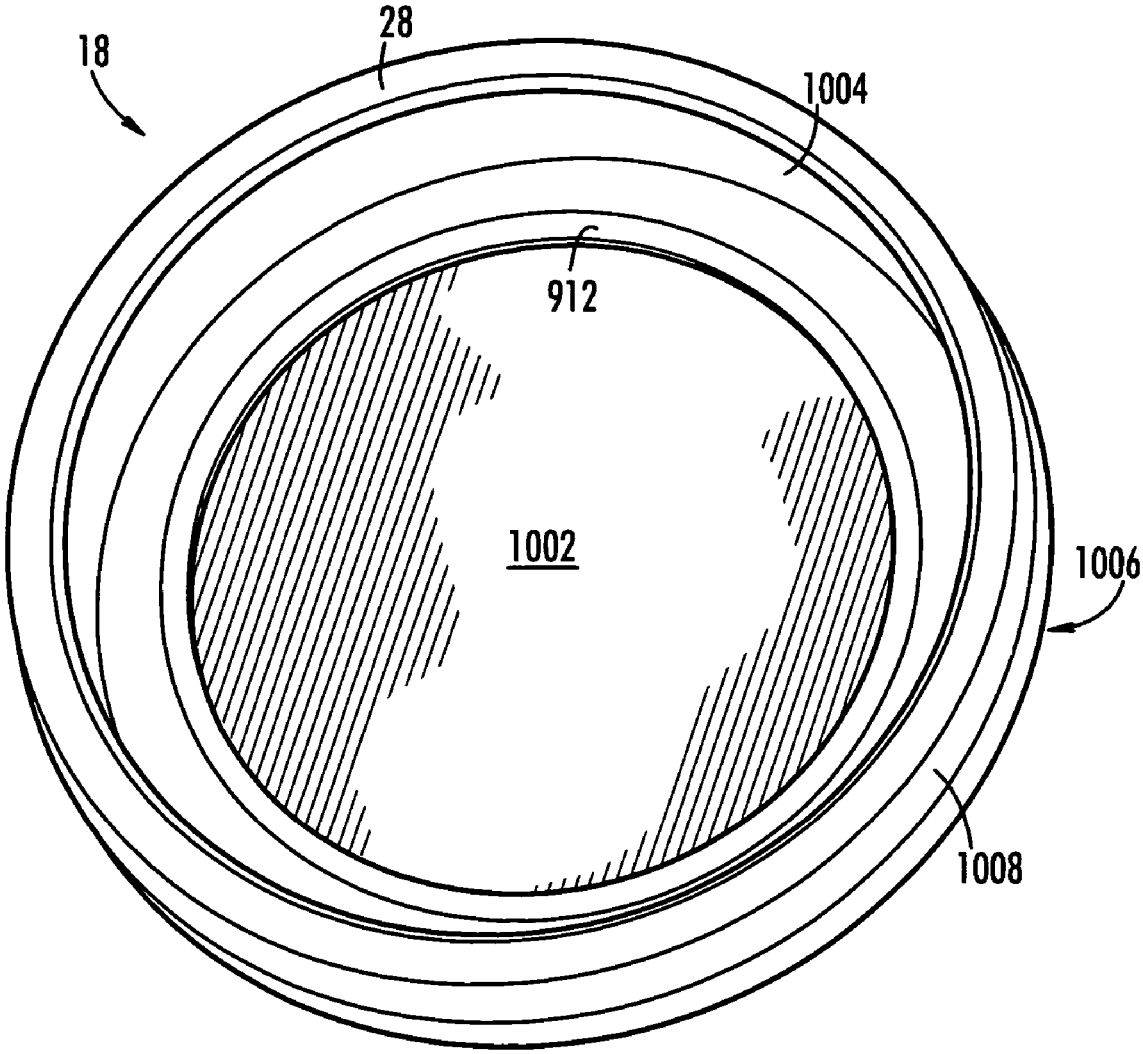
FIG. 10 is a top, perspective view of a shell pot that may be used in the loudspeaker of FIGS. 1 and 9.

FIG. 10 is a perspective view of an example shell pot 18. The shell pot 18 includes the annular rib 912 formed in a floor 1002 of the shell pot 18. The rib 912 in combination with the floor 1002 may form a recess to accommodate and engage a portion of the magnet 16. In FIG. 10, the rib 912 extends substantially perpendicularly away from the floor 1002. In another example, the floor 1002 may be formed with a recess in which the rib 912 is a portion of the floor 1002 and forms an outer boundary of the recess. The floor 1002 may radially extend to an annular wall 1004 formed perpendicular to the floor 1002. The annular wall 1004 is formed to include a rim 28. As previously discussed, the rim 28 is formed to be coupled with a peripheral edge of the diaphragm 14. The rim 28 may be integrally formed as part of the annular wall 1004, or may be a unitary part of the annular wall 1004. An outer surface 1006 of the annular wall 1004 may include a notch 1008 as best illustrated in FIGS. 1 and 9. The notch 1008 may be formed by tapering a portion of the outer surface 1006 of the annular wall 1004 that is near and/or part of the rim 28. The notch 1008 may circumferentially extend around the periphery of the shell pot 18. In another example, the rim 28 may be formed to extend beyond the annular wall 1004 to form the notch 1008.

Figure 11:
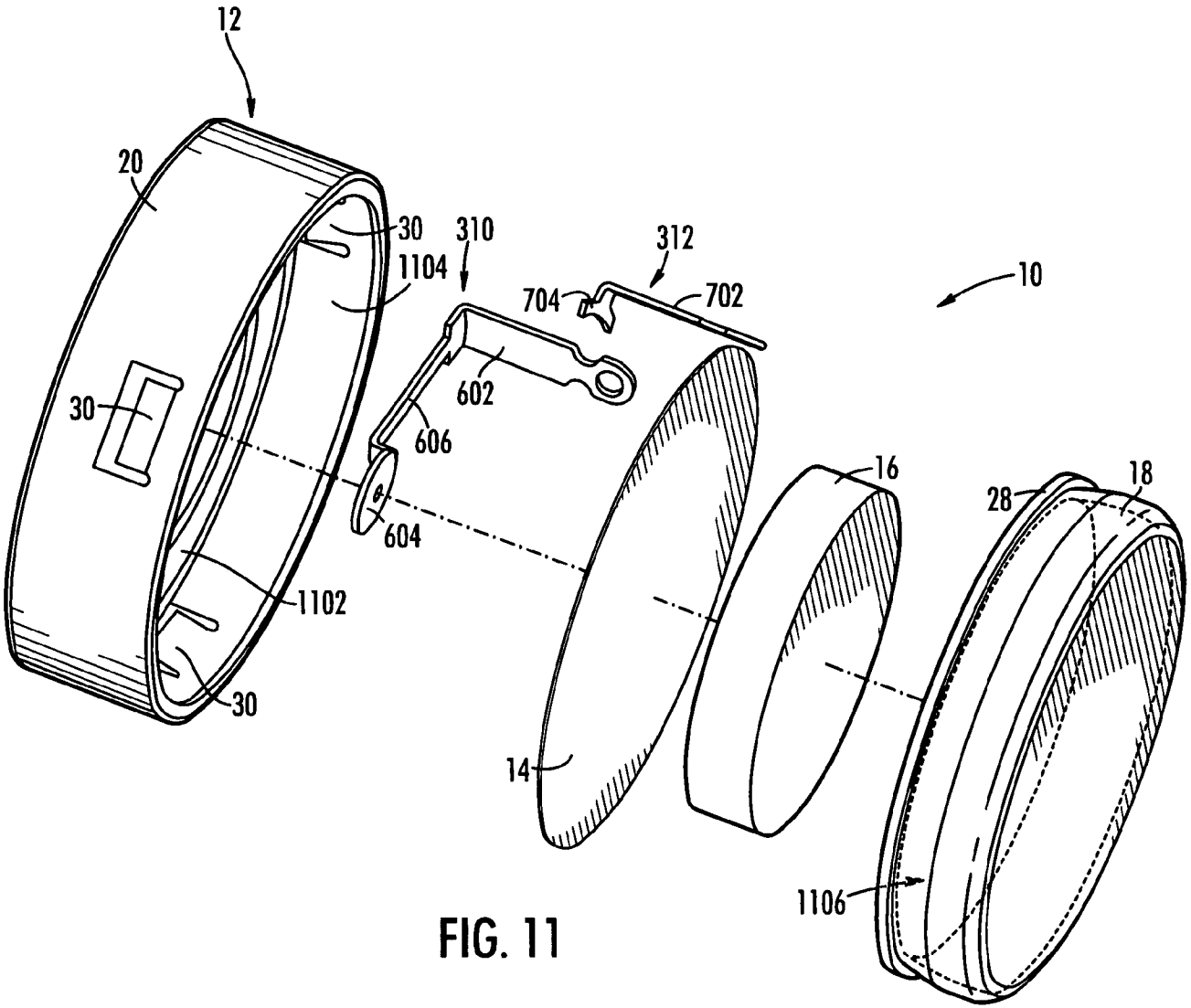
FIG. 11 is an exploded view of an example planar loudspeaker.

FIG. 11 is an exploded view of the loudspeaker assembly 10. As previously discussed, the inner terminal 310 and the outer terminal 312 may be a unitary part of, and/or integrally formed in the face plate 12. Alternatively, as illustrated in FIG. 11, the inner and outer terminals 310 and 312 may be coupled with a base wall 1102 and an annular wall 1104. The combination of the base wall 1102 and the annular wall 1104 may form a housing that is the face plate 12. To assemble the loudspeaker 10, the magnet 16 may be secured in a cavity 1106 formed within the shell pot 18. For example, the rib 912 (FIG. 9) in the shell pot 18 may be used to fix the position of the magnet 16.

The perimeter of the diaphragm 14 may be attached to the rim 28 of the shell pot 18, such as by using adhesive, to form a cover over the cavity 1106. By sliding the face plate 12 over the shell pot 18, the clips 30 may engage the rim 28 of the shell pot 18 and lock in place as best illustrated in FIG. 9. Additionally, the phase plug 802 (FIG. 9) and/or the first contact 604 of the face plate 12 may be used to distort the diaphragm 14. Since the outer contact 214 of the diaphragm 14 may surround a peripheral edge of the diaphragm 14, and the inner contact 212 may be substantially centrally located, to create an electrical connection, only axial alignment is necessary when the face plate 12 is slid over a portion of the shell pot 18.

Figure 12:
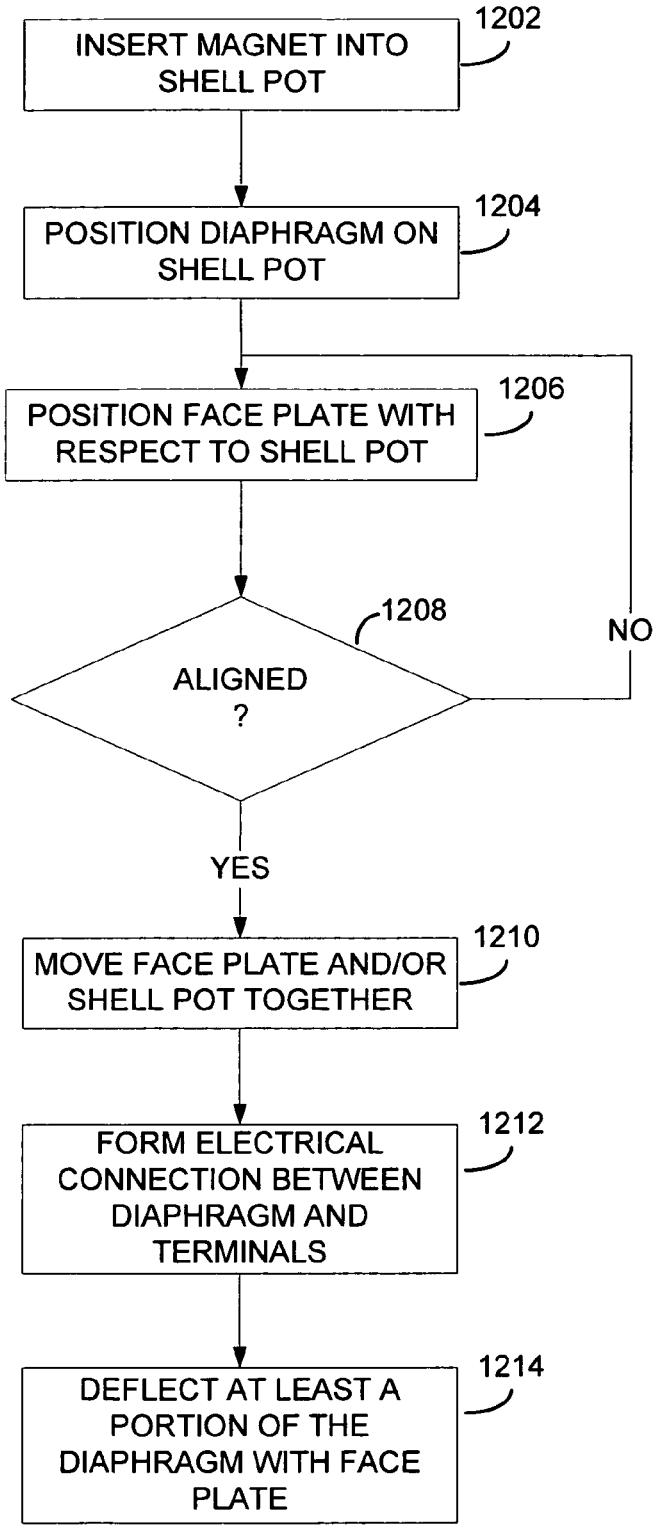
FIG. 12 is an example method of manufacture of the planar loudspeakers of FIGS. 1-11.

FIG. 12 is an example process for manufacturing the planar loudspeaker 10 that is described with reference to FIGS. 1-11. At block 1202, the magnet 16 is inserted into the cavity 1106 formed in the shell pot 18. The magnet 16 may be held in position in the shell pot 18 with the annular rib 912. At block 1204, the diaphragm 14 is positioned to cover an entrance to the cavity 1106, and a perimeter of the diaphragm 14 is coupled with the rim 28 of the shell pot 18. When initially coupled to the rim 28, the planar surface of the diaphragm 14 is substantially coplanar with the longitudinal plane formed by the rim 28. In addition, the planar surface of the diaphragm 14 is substantially parallel with the surface of the magnet 16. The diaphragm 14 is positioned so that the conductive path 210 included on/in the diaphragm 14 is intersected by the magnetic field produced by the magnet 16.

At block 1206, the face plate 12 is positioned substantially concentric with respect to the shell pot 18 so that the diaphragm 14 is between the shell pot 18 and the face plate 12. The annular wall of the face plate 12 may be aligned to be outside the rim 28 of the shell pot 18. At block 1208, it is determined if the face plate 12 is aligned with the shell pot 18. Alignment with the shell pot 18 simple involves confirming that the annular wall of the face plate 12 is circumferentially positioned outside of the shell pot 18.

As previously discussed, alignment related to electrically coupling the shell pot 18 with the face plate 12 may not be required due to the rotationally independent electrical connection between the terminals 310 and 312 included on the face plate 12, and the inner and outer contacts 212 and 214 included on the conductive path 210. In addition, rotational alignment related to engaging the face plate 12 and the shell pot 18 may also be avoided since the clips 30 that may be included on the face plate 12 may be interlocked with the notch 1008 included on the shell pot 18 anywhere around the shell pot 18. The rotational alignment to engage the face plate 12 and the shell pot 18 may be unnecessary since the notch 1008 is formed around the outside of the entire annular wall of the face plate 12 adjacent to the rim 28 such that engagement of the rim 28 with the clips 30 may occur at any point around the annular wall of the face plate 12.

If the face plate 12 and the shell pot 18 are not aligned, the operation returns to block 1206 to reposition the face plate 12 and the shell pot 18 with respect to each other. If the face plate 12 and the shell pot 18 are satisfactorily aligned, at block 1210, the face plate 12 and/or the shell pot 18 may be moved toward each other so that the clip(s) 30 engage with the notch 1008. At about the same time, at block 1212, the inner contact 212 of the conductive path 210 comes into direct contact with the first contact 604 of the inner terminal 310 to form a low resistance electrical connection therebetween. Also, the outer contact 214 of the conductive path 210 comes into contact with the second contact 704 of the outer terminal 312 to form a low resistance electrical connection therebetween. As previously discussed, the method could also include the additional step of positioning one or more compliant electrical interfaces on at least one of the inner contact 212 and the first contact 604 and/or the outer contact 214 and the second contact 704 so that the compliant electrical interface is compressed between the respective contacts 212, 214, 604 and/or 704.

As the face plate 12 and the shell pot 18 are moved toward each other at block 1210, at block 1214, only a portion of the diaphragm 14 may be deflected by the apex of a raised area of the phase plug 802 included in the face plate 12. The raised area of the phase plug 802 may also include the first contact 604. The inner contact 212 and the first contact 604 may be held in contact, and/or compressed between the raised area of the phase plug 802 and the surface of the magnet 16. Since at least a portion of the diaphragm 14 is deflected outside of the longitudinal plane formed with the rim 28, a portion of the diaphragm 14 is suspended under tension in an airspace, and may vibrate freely. Following deflection, the diaphragm 14 may be generally conically shaped. Since the diaphragm 14 is under tension, the diaphragm is maintained in the air space. In addition, due to the tension, distortion in the sound produced by vibration of the diaphragm 14 may be advantageously reduced.

The previously described embodiments provide a planar loudspeaker designed to be more economical to manufacture, and yet not compromise the quality of sound waves emitted. By elimination of the need for solder connections within the loudspeaker, and complex and/or labor intensive alignment procedures during the assembly process, assembly efficiency, and quality of assembly may be improved. In addition, due to the decrease in precision to perform alignment and electrical connection when compared to assembly of other loudspeakers, the assembly process may be more easily automated.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A planar loudspeaker comprising:

a diaphragm including a conductive path with an inner contact positioned proximate to a central axis of the diaphragm and an annular outer contact;

a magnet positioned proximate to the diaphragm such that a magnetic field produced by the magnet intersects the conductive path;

a shell pot dimensioned to receive the magnet;

a face plate adapted to be coupled to the shell pot, the face plate including an inner terminal with a first contact and an outer terminal with a second contact, wherein the first contact forms a first electrical connection with the inner contact and the second contact forms a second electrical connection with the annular outer contact; and the face plate further including a radiating opening positioned between the first contact and the second contact.

2. The planar loudspeaker of claim 1, where the outer contact is substantially circular in shape and substantially surrounds the inner contact.

3. The planar loudspeaker of claim 1, where the inner contact is substantially concentric with respect to the outer contact.

4. The planar loudspeaker of claim 1, where the face plate includes the radiating opening adapted to direct transmission of sound waves, the radiating opening being positioned between the first contact and the second contact.

5. The planar loudspeaker of claim 1, where the an electrical connection between the first contact and the inner contact is solderless.

6. The planar loudspeaker of claim 1, where the electrical connection between the second contact and the outer contact is solderless.

7. The planar loudspeaker of claim 1, where the face plate comprises a planar base wall and an annular wall extending from the perimeter of the base wall, the first contact and the second contact being substantially coplanar with the base wall.

8. The planar loudspeaker of claim 1, further comprising a compliant electrical interface compressibly disposed between at least one of the first contact and the inner contact or the second contact and the outer contact, wherein the compliant electrical interface comprises a substantially deformable conductive material which forms a low resistance conductive path between at least one of the first contact and the inner contact or the second contact and the outer contact.

9. A planar loudspeaker, comprising:

a diaphragm that comprises a conductive path having an inner contact and an outer contact;

a magnet positioned proximate to the diaphragm such that a magnetic field produced by the magnet intersects the conductive path;

a shell pot dimensioned to receive the magnet; and a face plate adapted to be coupled to the shell pot, the face plate comprising an inner terminal that includes a first contact and an output terminal that includes a second contact, where the first contact is positioned on the face plate such that at least a portion of the first contact is aligned with at least a portion of the inner contact to form a first electrical connection between the first contact and the inner contact, and where the second contact is positioned on the face plate such that at least a portion of the second contact is aligned with at least a portion of the outer contact to form a second electrical connection between the second contact and the outer contact.

10. The planar loudspeaker of claim 9, where the first contact is positioned on the face plate such that at least a portion of the first contact directly contacts at least a portion of the inner contact.

11. The planar loudspeaker of claim 10, where the second contact is positioned on the face plate such that at least a portion of the second contact directly contacts at least a portion of the outer contact.

12. The planar loudspeaker of claim 9, where the inner terminal is formed as a unitary part of the face plate.

13. The planar loudspeaker of claim 12, where the outer terminal is formed as a unitary part of the face plate.

14. The planar loudspeaker of claim 9, where the first contact of the inner terminal is positioned on the face plate proximate to a central axis of the face plate.

15. The planar loudspeaker of claim 14, where the second contact of the outer terminal is positioned on the face plate proximate to a perimeter of the face plate.

16. A planar loudspeaker, comprising:

a diaphragm including a conductive path with an inner contact and an outer contact;

a magnet positioned proximate to the diaphragm such that a magnetic field produced by the magnet intersects the conductive path;

a shell pot dimensioned to receive the magnet;

a face plate adapted to be coupled to the shell pot, where only a portion of the face plate is dimensioned to contact the diaphragm such that a portion of the diaphragm is displaced below a planar surface defined by a perimeter of the diaphragm; and the face plate further comprising a conductive inner terminal that is in electrical contact with the inner contact, and is configured to receive an audio signal.

17. The planar loudspeaker of claim 16, where the portion of the diaphragm that is displaced comprises a conical shape.

18. The planar loudspeaker of claim 16, where at least a portion of the inner contact is displaced below the planar surface defined by the perimeter of the diaphragm.

19. The planar loudspeaker of claim 16, where the face plate comprises a first contact adapted to directly contact the inner contact, the face plate being configured such that the first contact displaces at least part of the inner contact to be outside of the planar surface defined by the perimeter of the diaphragm.

20. The planar loudspeaker of claim 16, where the face plate is operable to move the portion of the diaphragm into contact with the magnet.

21. The planar loudspeaker of claim 16, where the face plate comprises a tapered surface, and an apex of the tapered surface contacts the diaphragm.

22. The planar loudspeaker of claim 16, where the tapered surface forms a predetermined angle with an adjacently positioned surface of the magnet.

23. The planar loudspeaker of claim 16, where the face plate comprises a conductive outer terminal that is directly in contact with the outer contact, and is configured to receive an audio signal.

24. A planar loudspeaker comprising:

a shell pot formed to include a cavity;

a magnet disposed in the cavity;

a diaphragm formed with a planar surface and including a conductive path with an inner contact and an outer contact, the diaphragm coupled with the shell pot to be adjacent to a surface of the magnet, and to cover an entrance to the cavity;

a face plate coupled with the shell pot, the face plate comprising a phase plug that is operable to contact and deflect only a portion of the diaphragm into contact with the magnet; and the face plate further comprising a conductive inner terminal that is in electrical connection with the inner contact.

25. The loudspeaker of claim 24, where a remainder of the diaphragm is spaced away from the magnet and the face plate, and is configured to freely vibrate.

26. The loudspeaker of claim 24, where the surface of the magnet is a planar surface, and the phase plug includes a raised surface that contacts the diaphragm at an apex of the raised surface.

27. The loudspeaker of claim 24, wherein the shell pot includes a rim that a perimeter of the diaphragm is coupled with, and the portion of the diaphragm is deflected to be outside a longitudinal plane defined by the rim and the perimeter of the diaphragm coupled thereto.

28. The planar loudspeaker of claim 24, where the inner contact of the conductive path is positioned proximate to a central axis of the diaphragm.

29. The planar loudspeaker of claim 28, where the outer contact of the conductive path is positioned proximate to a perimeter of the diaphragm.

30. The planar loudspeaker of claim 29, where the outer contact is substantially annular in shape and substantially surrounds the inner contact.

31. The planar loudspeaker of claim 24, where the surface of the magnet is tapered such that a first portion of the surface is in contact with the diaphragm and a second portion of the surface slopes away from the diaphragm.

32. The planar loudspeaker of claim 24, where the surface of the magnet is a first surface, and the magnet includes a second surface opposite the first surface that is contiguous with the shell pot, where at least a portion of the first surface is formed in a plane that is not parallel with the second surface.

* * * * *